United States Patent [19]

Storey

[11] Patent Number: 4,860,628

[45] Date of Patent: Aug. 29, 1989

[54] STRING SUPPORTING APPARATUS FOR STRINGED MUSICAL INSTRUMENTS

[76] Inventor: David C. Storey, 1012 Mill Pl., Santa Paula, Calif. 93060

[21] Appl. No.: 202,545

[22] Filed: Jun. 6, 1988

[51] Int. Cl.[4] ..... G10D 3/04

[52] U.S. Cl. ..... 84/313; 84/299; 84/314 N

[58] Field of Search ..... 84/297 R, 298, 299, 84/307, 312 R, 313, 314 N

[56] References Cited

U.S. PATENT DOCUMENTS

| | | | |
|---|---|---|---|
| 3,411,394 | 11/1968 | Jones | 84/313 |
| 4,341,144 | 7/1982 | Milne | 84/307 |
| 4,425,832 | 1/1984 | Peavey | 84/298 |

*Primary Examiner*—Lawrence R. Franklin
*Attorney, Agent, or Firm*—Laubscher, Presta & Laubscher

[57] ABSTRACT

String supporting apparatus for stringed musical instruments, such as guitars, comprises a plurality of saddles, each having a string supporting V-notch, a plurality of brackets, each configured for tightly holding one of the saddles; and spring means for flexibly mounting the brackets to the instrument so that the saddle V-notches support the strings at either or both the instrument head-end and body-end string break points. Thus, the apparatus may be mounted at either or both the instrument nut and bridge. Each bracket includes a clamp for fixing the string supported by the associated saddle V-notch adjacent to the support point. The spring mounting of the brackets enable tuning of the instrument without unclamping the strings, for example, by tensioning the strings by the machine heads when the apparatus is installed at the nut and by pitch tensioning screws when the apparatus is installed on the bridge. Installation at the bridge eliminates lateral string movement at the body-end string break points, which occurs when rollers are used to support the strings, thereby improving instrument sound sustaining qualities.

22 Claims, 2 Drawing Sheets

STRING SUPPORTING APPARATUS FOR STRINGED MUSICAL INSTRUMENTS

BACKGROUND OF THE INVENTION

1. Field of the Invention

The present invention relates generally to the field of stringed musical instruments, especially to those of the plucked rather than the bowed types, and more particularly to apparatus for supporting the strings of the instrument and for enabling harmonic and pitch adjustment of the strings.

2. Discussion of the Prior Art

It is, of course, well known that such stringed musical instruments as guitars have a number of side-by-side strings which are stretched along a relatively slender, elongated neck of the instrument. One end of each string is individually attached to a bridge mounted to the body of the instrument and the other end of each string is connected to individual string tensioning apparatus, for example, a manually turnable tuning peg, mounted to, or formed as a part of the instrument head.

Most such instruments are also constructed so as to have string break points relatively adjacent to both end attachments over which the strings pass and which establish the vibrational length of the strings. Such string break points are typically provided by a so-called nut at the head of the instrument and by string saddles mounted to the bridge. Typically apparatus is provided at the bridge for moving the saddles on an individual basis to adjust the vibrational or harmonic length of the individual strings. Gross and fine string tensioning or pitch adjustments are provided as well. Ordinarily, the tuning pegs provide the gross tensioning; whereas, fine pitch adjustment is typically provided by adjusting screws associated with the bridge.

On many such plucked string instruments as guitars, the bridge is mounted for enabling manual pivoting, to thereby simultaneously change the pitch (tension) of all the strings to produce a vibrato effect. Such bridges, typically called tremulo bridges, are pivotally mounted to the instrument body and are maintained in a normal, string tensioned position by strong springs against which the tensioned strings pull. A protruding tremulo lever mounted to the bridge enables the instrument player to pivot the bridge so as to slacken the strings and change string pitch. Upon release of the tremulo lever, the springs return the bridge to the normal, static position for which the instrument is tuned.

As may be appreciated, the repeated and often violent slackening and retensioning of the strings by operation of the tremulo bridge during playing of the instrument makes keeping the instrument in tune very difficult. For example, when the strings are slackened, the coils of the strings around the tuning pegs loosen. These loosened coils are not, however, instantaneously tightened when the tremulo lever is released and so the tensioning (pitch) of the strings changes while the coil retightening continues. To eliminate such pitch change problems, string clamps may be provided between the nut and the tensioning pegs, usually closely adjacent to the nut. After the unclamped strings have been properly tensioned by turning of the tuning pegs, the strings are tightly clamped at the nut-end string break point. As a result, slackening of the strings by operation of the tremulo bridge does not affect the portion of the strings between the nut-end string clamps and the tuning pegs. In a like manner, string clamps are usually provided between the string saddle and the string attachment at the bridge.

Particular problems are, however, associated with nut-end string clamping. The instruments may ordinarily require some tuning or retuning during play, as a result, for example, of the strings being stretched by rough playing and repeated operation of the tremulo bridge. Typically, the necessary string retensioning is most conveniently accomplished by relatively slight manual adjustments of the tuning pegs. It can, however, be appreciated that the tuning pegs cannot be used to retension the strings unless the strings are first unclamped at the nut. Thus, to retension the strings by use of the tuning pegs, the strings must be unclamped, the tuning peg adjustment made and the strings then reclamped. Because of the close, side-by-side spacing of the strings at the nut clamps, such clamps ordinarily require the use of a tool to operate, thereby making clamping and unclamping of the strings both inconvenient and time consuming, and therefore usually impractical for "on-stage" tuning of the instruments.

At the bridge, provisions are generally made to enable fine pitch tuning of the strings without changing the location of the bridge-end string break point. That is, so that the fine pitch tuning operation does not change the vibrational length of the strings. For example, U.S. Pat. No. 4,497,236 to Rose, discloses roller-type saddles over which the strings are passed and which form or define the bridge-end string break point. After passing over radially curved portions of the rollers, the strings are clamped to flattened regions of the rollers. Fine pitch tuning is provided by apparatus which operate on extending arm portions of the clamps so as to cause partial rotation of the rollers against which the strings are clamped. The initial contact of the strings as they pass from the instrument neck over the rollers defines the bridge end break point, and as the rollers are partially rotated, to adjust string pitch, the string break point stays fixed relative to the bridge. As a result, the harmonic or vibrational length does not change as a string is pitch tuned.

However, due both to manufacturing tolerances and side clearances required to assure free pivoting of such rollers, some amount of lateral roller play is inevitable. Consequently, a corresponding amount of lateral string movement is permitted where the strings are supported by these rollers. It has been found and is generally known that when the instrument is played, such lateral string movement at the break point, even though the lateral movement may be only a very few thousandths of an inch, causes the instrument to have poor sound sustaining qualities. That is to say, only slight lateral string movement at the bridge-end break point results in a noticeable reduction in the length of time the strings keeps vibrating after they are plucked.

It has further been determined that the small amount of lateral string movement permitted by roller supporting of the strings at the bridge has very much more of an adverse musical effect than would any change in vibrational length of the strings caused by pitch adjustment if rollers were not used to maintain a constant string vibrational length.

For these and other reasons, improvements to string supporting and clamping apparatus for use on such stringed instruments as guitars are needed in order to improve the convenience of tuning while at the same time improving sound sustaining qualities of the instrument.

SUMMARY OF THE INVENTION

According to the present invention, flexible string supporting apparatus for a musical instrument, having a plurality of longitudinally extending strings stretched between a head and a body of the instrument, having head-end and body-end string break points which establish the vibrating length of the strings and having string tensioning means for adjusting string tensioning, comprises a plurality of string supporting means, each having a laterally fixed, string supporting surface and means for resiliently mounting the string supporting means at at least one of the head-end and body-end string break points, with each of the strings being supported by the string supporting surface of a corresponding one of the string supporting means. The mounting means are configured for permitting the string supporting surface of each of the supporting means to deflect independently, preferably a limited distance, in the longitudinal string direction in response to tensioning adjustment of the strings by the tensioning means, the vibrating length of the string being thereby caused to change. Included in the apparatus are means for fixing the strings to the associated string supporting means adjacent to the string supporting surfaces.

According to an embodiment of the invention, each of the string supporting means comprise a string saddle member and a saddle mounting element, the mounting element including means defining a recess into which the saddle member is tightly received. Preferably, the string fixing means are then connected to the saddle mounting element and the string supporting surface comprises means defining a generally V-shaped notch in outer regions of the saddle member.

The resilient mounting means may comprise a plurality of spring elements and means for attaching individual ones of the string supporting means to a corresponding ones of the spring elements.

In one embodiment, the resilient mounting means comprise an elongate angle having a first leg and a second leg and including means dividing the second leg into the plurality of spring elements. Such dividing means may comprise means defining a slot between each one of the elements. Moreover, the means for attaching the string supporting means to corresponding ones of the spring elements preferably include means for enabling height adjustment of the supporting means relative to the resilient mounting means.

The resilient mounting means are, in one instance, configured for mounting the string supporting means at the head-end string break point at a nut position on the instrument. Whereas, in another instance, the mounting means are configured for mounting the string supporting means to a bridge at the body-end string break point. A tremulo bridge may be included, in which case the mounting means mount the string supporting means to a fixed portion of the tremulo bridge, and including means for mounting the tremulo bridge to the instrument body with the string supporting means positioned at the body-end string break point.

When the instrument has string take up means mounted to the head for causing individual tensioning of the strings and when the string supporting means are mounted to the instrument with the string supporting surface at the head-end break point, the resilient mounting means permit the string supporting means to deflect individually in the longitudinal string direction in response to the loosening or tightening of the strings by the string take up means. Location of the head-end string break point is thereby longitudinally shifted and the vibrational length of the strings is thereby changed according to the amount of deflection of the string supporting means caused by loosening or tightening of the strings by the string take up means. The string fixing means preferably clamp the string between the string supporting surfaces and the string take up means so that loosening the strings between the head-end and the body-end string break points, as when the instrument is played, does not cause loosening of the strings between the fixing means and the string take up means.

Also, or in the alternative, when a bridge is provided which has pitch tuning means for causing the individual pitch tuning of the strings and the string supporting means are mounted to the bridge so that the string supporting surfaces are at the body-end string break point, with the strings supported by corresponding ones of the string supporting means, the mounting means permit the string supporting means to deflect individually in the longitudinal string direction in response to loosening or tightening of the strings by the pitch tuning means. The location of the body-end string break point is thereby longitudinally shifted and the vibrational length of the strings is thereby changed according to the amount of deflection of the string supporting means caused by the loosening or tightening of the strings by the pitch tuning means.

In such case, the resilient mounting means comprise a plurality of angle members each having a first leg and a second leg formed at about right angles thereto, and further include means for mounting the first legs to the bridge and means for attaching individual ones of the string supporting means to corresponding ones of the second legs. Moreover, the string supporting apparatus means for attaching the string supporting means to the second legs are preferably configured for permitting limited height adjusting of the supporting means relative to said second legs. Also, the fixing means preferably clamp the strings between the string supporting surfaces and the pitch tuning means.

BRIEF DESCRIPTION OF THE DRAWINGS

A better understanding of the present invention may be had from a consideration of the following detailed description, taken in conjunction with the accompanying drawings in which.

DESCRIPTION OF THE PREFERRED EMBODIMENT

Figure 1:
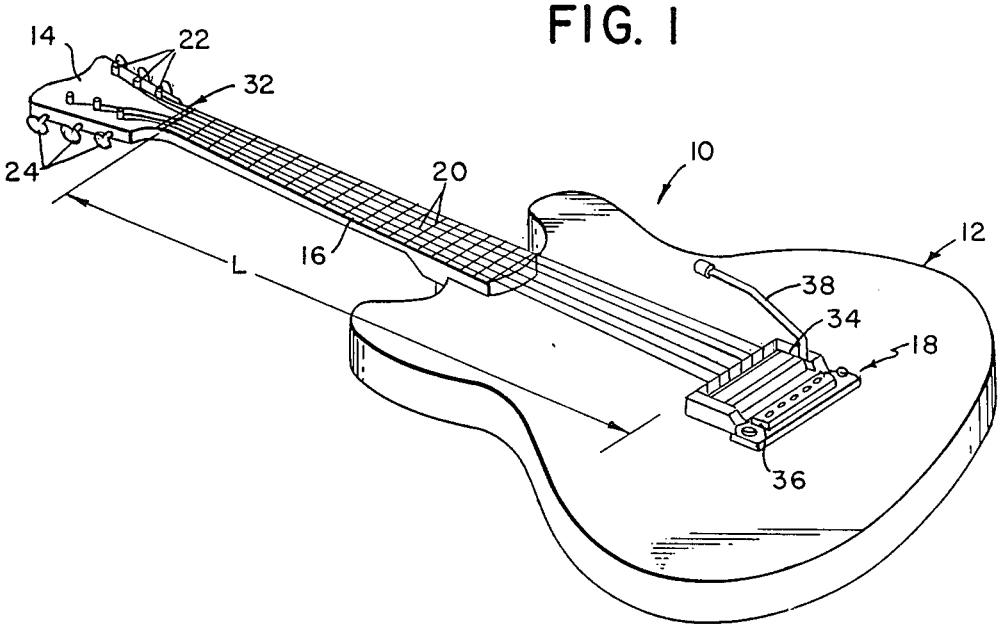
FIG. 1 is a perspective drawing of an exemplary stringed musical instrument (a guitar) on which the string supporting apparatus of the present invention may be used to advantage.

There is shown in FIG. 1 an exemplary stringed musical instrument 10, for example, an electric guitar, on which the present invention, more particularly described below, may be used to advantage. Comprising generally instrument 10 are a body 12, a head 14 and an elongated, slender neck 16 which interconnects the head and body. Shown mounted to body 12, in longitudinal alignment with neck 16 is a bridge assembly 18.

Tautly stretched between bridge assembly 18 and head 14, so as to extend along neck 16, is a plurality of strings 20, six such strings being commonly used on the type of musical instrument depicted. One end of each of strings 20 is detachably connected to bridge assembly 18, the other end of each of the strings being adjustably connected to machine heads 22 mounted in head 14. Tuning pegs 24 are interconnected with machine heads 22, around which strings 20 are wrapped, to enable manual turning of the machine heads to thereby tension strings 20 as necessary to provide the desired musical tones when the strings are plucked.

Mounted to instrument 10 at about the neck-to-head transition point, is a head-end, string support assembly or nut 32 over which strings 20 pass in contact therewith. Bridge assembly 18 includes a bridge-end, string support saddle assembly 34 over which strings 20 also pass in contact. Nut 32, which is close to the head end of strings 20, and saddle assembly 34, which is close to the bridge end of the strings, establish respective head-end and bridge-end string break points between which the strings are unsupported and do not contact any part of instrument 10, except perhaps when the instrument is being played. String contact points of nut 32 and saddle assembly 34 are longitudinally spaced apart a string distance, "L", which may, according to orientation of the nut and saddle assembly, be slightly different for different ones of strings 20. As shown, strings 20 may fan out from nut 32 across head 14 to machine heads 22.

For purposes of illustration, bridge 18 is shown to be of the tremulo type, having pivotally mounted portions 36 (described below) to which is connected an elongate, manually operated lever 38. As is well known to players of such instruments 10, the manual depressing of lever 38 causes tension to be reduced in strings 20, thereby changing the musical tones provided thereby when plucked or strummed. Springs connected to portion 36 cause such portion to return to a normal, static position when tremulo lever 38 is then released, strings 20 being supposed to return to their static tensioning.

It can be appreciated that if nut 32 merely functions as a string guide, slackening of strings 20, by depressing of tremulo lever 38, permits the coils of string around machine heads 22 to loosen. When lever 38 is then released, tension in strings 20, and hence tone produced thereby, changes as the string coils around machine heads 22 gradually retighten. For such reason, strings 20 are commonly clamped at nut 32, relatively adjacent to the head-end string break point on the head side, so that string tension remains relatively constant between the nut and machine heads 22 even when the strings are slackened between the break points by the depressing of tremulo lever 38. In a like manner, clamping of strings 20 at nut 32 prevents greater than normal tightening of string coils around machine heads 27 when string tension is increased. For example, when strings 20 are violently plucked, as is frequently the case, instrument tone may change when unclamped strings are released, due to the string coils around the machine heads reloosening in a non-instantaneous manner.

Due to frequent and quick releasing of tremulo lever, which causes instantaneous retensioning of strings 20, and also due to violent plucking and strumming of the strings, which causes increased string tension, the strings may frequently stretch somewhat as instrument 10 is played. Such stretching of strings 20 during play results in reduced string tension and therefore causes a change in tone of instrument 10. Consequently, some retuning of instrument 10, by retensioning strings 20, may, from time-to-time, be necessary during play. Such retensioning of strings 20 to bring instrument 10 back into tune is ordinarily accomplished by the turning of machine heads 22 by tuning pegs 24.

It can be appreciated that if rigidly clamped at nut 32, strings 20 must be unclamped before the string tension in length L can be changed by the turning of tuning pegs 24. After retensioning is accomplished, strings 20 must then be reclamped at nut 32 to avoid the above-mentioned problems. Such operations as the unclamping and reclamping of strings 20 at nut 32 are, however, usually difficult and may require use of special, small tools because of close spacing between the strings at the nut. Therefore, when an instrument has its strings rigidly clamped at the nut, retuning of the instrument on stage during a performance is usually impractical and, as a result, performers are usually required to have at least one back-up instrument to which they can switch when their principal instrument becomes out of tune. Alternative retunings of the principal and back-up instruments is then accomplished off-stage with proper tools and without necessity for hurrying. The problem then is that the instruments may not be tuned the way the performer wants them to be tuned.

Figure 2:
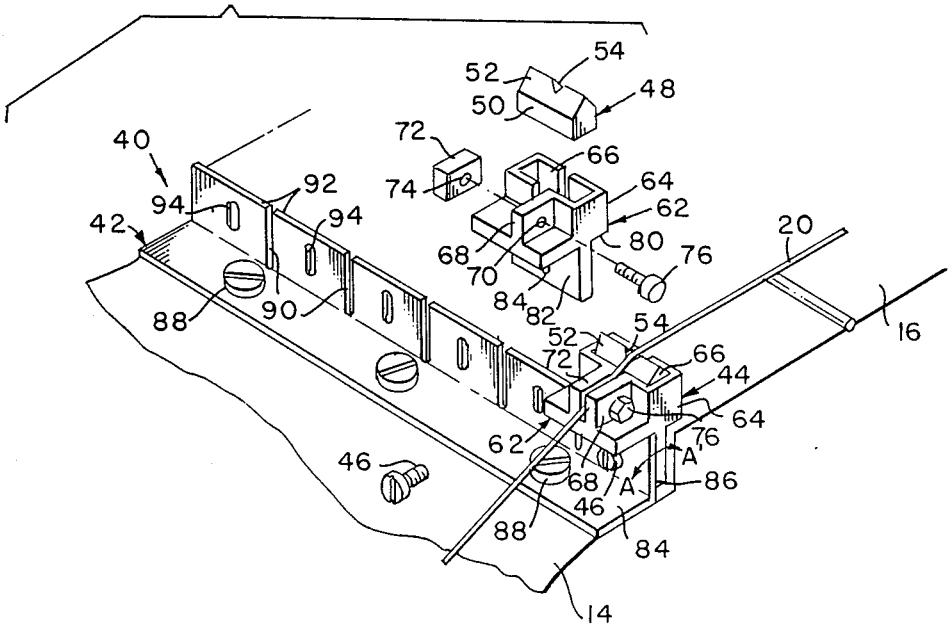
FIG. 2 is a fragmentary perspective drawing showing the string supporting apparatus of the present invention installed so as to form the so-called "nut" of the instrument.

As a substantial improvement to heretofore available string clamping nuts, the present invention provides string supporting apparatus 40 (FIG. 2) which is longitudinally flexible. As shown in FIG. 2, apparatus 40 comprises generally a spring member 42 and a plurality of string supporting and fixing means 44 which are adjustably connected to spring member 42 by a plurality of bolts 46, as described below.

String supporting and fixing means 44 comprise a string saddle element 48 having a rectangular base portion 50 and a wedge shaped upper portion 52. A V-shaped notch or recess 54 is formed downwardly into upper portion 52 for receiving, upon assembly, one of strings 20, such notch defining the nut-end string break point, as shown in FIG. 2.

Further comprising string supporting and fixing means 44 is a saddle receiving element 62 having an upper portion 64 into which is formed a downwardly extending recess or pocket 66 for receiving saddle element lower portion 50. Recess 66 and saddle element lower portion 50 are relatively sized so that when such lower portion is inserted into the recess, no relative motion between the saddle element 48 and saddle receiving element 62 in the lateral and longitudinal directions (relative to instrument 10) is permitted; that is, a tight fit is provided between elements 48 and 62.

Regions of saddle receiving element 62 adjacent recess 66 and facing instruments head 14 are cutaway so as to leave remaining a short, longitudinally extending, centrally located, upright web 68. Formed laterally through central regions of web 68 is an aperture 70. Web 68 forms one half of a string clamp. A square nut 72, having a threaded aperture 74 formed through is provided as the other half of the string clamp. A screw 76, which passes through web aperture 70, is threaded into nut aperture 74. Tightening of screw 76 clamps (fixes) the portion of string passing between web 68 and nut 72 to string supporting and fixing means 44 after the string has been properly tensioned by its tuning peg 24.

Extending downwardly from an under surface 80 of saddle receiving element upper portion 64 is a lateral web or flange 82 having centrally defined therethrough a threaded aperture 84 for receiving one of bolts 46. Preferably, as shown, web 82 is generally centrally positioned relative to under surface 80.

Spring member 42 is formed having a first, instrument mounting leg 84 and a second, supporting and fixing means mounting leg 86. First mounting leg is formed having a plurality of mounting apertures through which mounting screws 88 extend to attach spring member 42 to instrument 10 transverely across neck 16. Second leg 86 is divided, by a number of narrow, equally spaced apart, vertical slots 90, into a series of upwardly (for the orientation of FIG. 2) extending ears or tabs 92. Formed through each ear 92 is a vertically elongated aperture 94, through which one of screws 46 extends to mount one of supporting and clamping means 44 to each of the spring member ears, the screws extending into aperture 84. Elongated apertures 94 enable limited height adjustment of individual ones of supporting and clamping members 44, as may be necessary or desirable.

One string supporting and fixing means 44 is mounted, by one of screws 46, onto each one of mounting member ears 92. Widths of supporting and fixing means 44 and ears 92 are such as to enable individual flexing of the ears and, therefore, individual pivoting of the supporting and fixing means a limited distance in the string direction (direction of Arrow A—A, FIG. 2).

Mounting member 42 is constructed of a flexible material, such as spring steel, with ears 92 thereof being sufficiently flexible so that with strings 20 securely clamped to supporting and fixing means 44, the ears flex in response to the turning (by turning pegs 24) of machine heads 22 to increase or decrease string tensioning. As a result of string supporting and fixing means 44 being flexibly mounted in the above-described manner, instrument 10 can be quickly and easily retuned "on-stage" without the necessity of unclamping the strings. Ears 92 of mounting member 42 are, however, sufficiently rigid to maintain substantial string tension between nut 32 (actually apparatus 40) and machine heads 22. Thus, when tremulo lever 38 is depressed and strings 20 are slackened between nut 32 and bridge 18, the string coils around machine heads 22 do not loosen.

It will be appreciated that flexibility of ears 92 depends upon the material from which mounting member 42 is constructed, material thickness and width and length (height) of the ears. By way of specific example with no limitations intended or implied, mounting member 42 may be constructed of spring steel having a thickness of about 0.020 inches. Ears 92 of member 42 may be about 0.280 inches wide and about 0.250 inches long.

String supporting apparatus 40, in only slightly modified form, may also or alternatively, be used to advantage on bridge assembly 18, as described below with respect to FIGS. 3 and 4.

Figure 4:
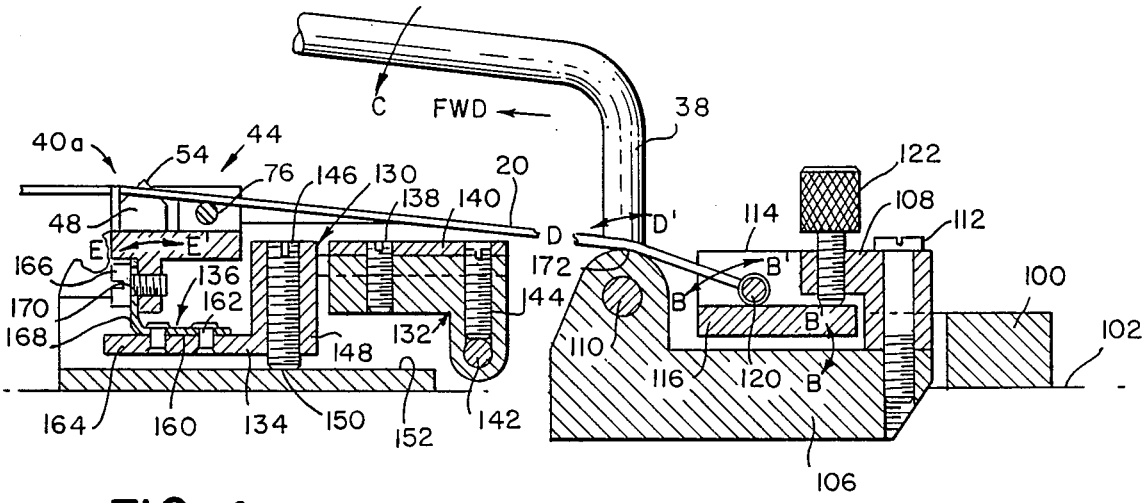
FIG. 4 is a cross-sectional drawing taken along line 4—4 of FIG. 3 showing the manner of installing the string supporting apparatus on the tremulo bridge.
Figure 3:
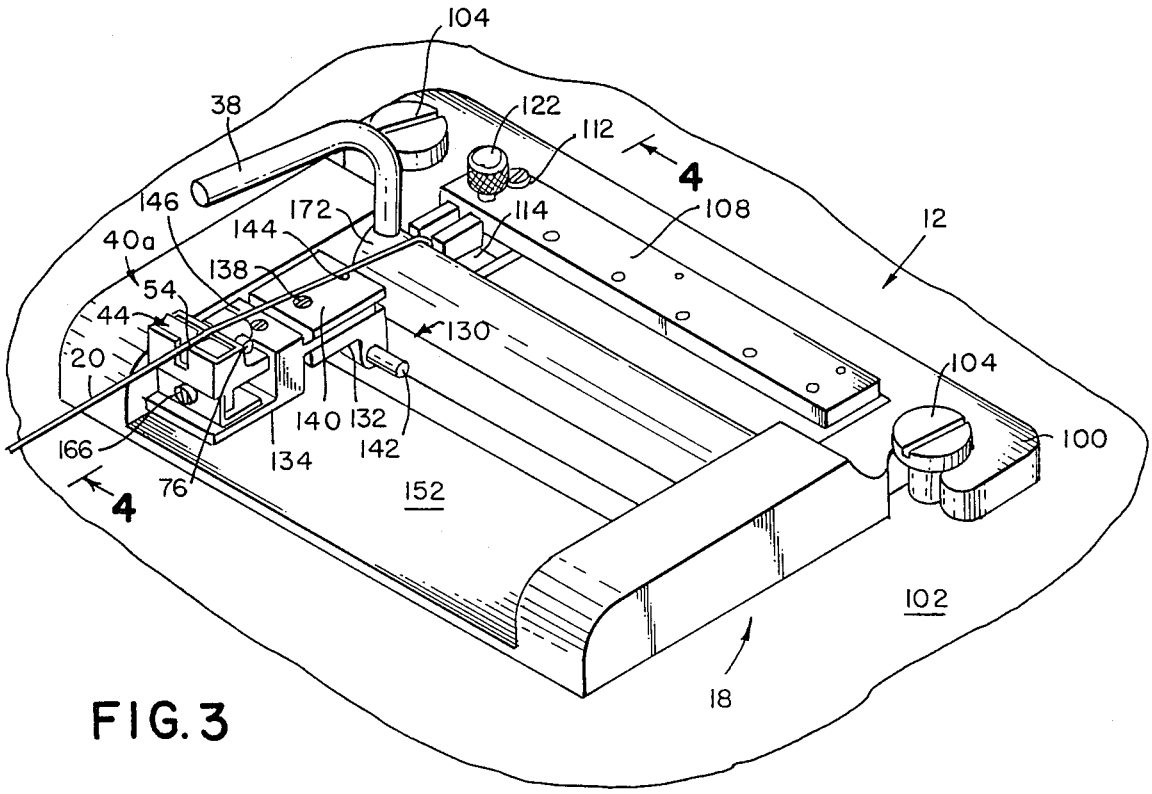
FIG. 3 is a fragmentary drawing showing the string supporting apparatus of the present invention installed on an exemplary tremulo bridge of the instrument.

By way of example, a variation string supporting apparatus 40*a* is shown in FIGS. 3 and 4 used with tremulo bridge 18 of the type and configuration disclosed in my U.S. Pat. Nos. 4,457,201 and 4,487,100, issued respectively on July 3, 1984 and Dec. 11, 1984, both of which are incorporated herein in their totality by specific reference.

Described generally, tremulo bridge 18 comprises a tailpiece block 100 which is mounted to an upper surface 102 of instrument body 12 by two screws 104. Included in bridge 18 are a tailpiece member 106 and a base 108, the tailpiece member being pivotally mounted to tailpiece block 100 by a transverse pivot pin 110 and the base being mounted to rearward portions of the tailpiece member by screws 112. One end of tremulo lever 38 is mounted into tailpiece member 106 so that movement of lever 38 causes pivoting of such member on pivot pin 110. A plurality of string end holders 114 are pivotally mounted, in a side-by-side relationship, onto a transverse shaft 116 which is, in turn, mounted through sides of base 108 (FIG. 4). Each of holders 114 is formed having a retaining slot 118 into which a ball end 120 of one of strings 20 is received. A knurl-headed screw 122, threaded into base 108, is provided for each string end holder 114 to enable pitch tensioning of the strings 20 by causing pivotal movement of the holders, in the direction of Arrows B-B', about mounting shaft 116.

Restoring springs (not shown) are connected between tailpiece block 100 and lower regions of tailpiece member 106 to counterbalance tension in strings 20 and thereby maintain the tailpiece member in the static, neutral position shown in FIG. 4. Stops (not shown) may be provided against which the restoring springs pull tailpiece member 106. Pressing tremulo lever 38 downwardly (direction of Arrow C, FIG. 4) causes tailpiece member 106 to pivot against the restoring springs, in the counterclockwise direction (direction of Arrow D). When tremulo lever 39 is then released, the springs cause tailpiece member 106 to pivot clockwise (direction of Arrow D') back to the static, neutral position.

A plurality of support member assemblies 130 are provided, each one of which comprises generally a journal block 132, a support 134, a spring angle mount 136 and string supporting and fixing means 44 (as above-described). Support 134 is slotted and is connected for longitudinal position adjustment, by a screw 138 and a top plate 140, to journal block 132. In turn, each journal block 132 is mounted for pivotal and lateral positional adjustment on a transverse mounting shaft 142 which is received through opposing sides of tailpiece 100 forwardly of shaft 110. A set screw 144 is threaded through journal block 132 for locking the block, and hence, support member assembly 130, on shaft 142 against rotational and lateral movement, the lateral separation between adjacent ones of the blocks being determined by width of the blocks and spacing of strings 20.

Forwardly of journal block 132, an adjusting screw 146 is threaded vertically (for the orientation of FIG. 4) through a central region 148 of support 134. Screw 146 enables height adjustment of string supporting and fixing means 44, and hence of an associated one of strings 20, a bottom end surface 150 of the screw bearing against an inner, upper surface 152 of tail-piece block 100. Tension in strings 20 maintains screw end surface 150 and tailpiece block surface 152 in contact. Journal block screw 144 must, of course, be loosened in order to enable string height adjustment by adjusting screw 146.

The plurality of spring angle mounts 132 correspond collectively to above-described angle mounting member 42. Instead of the roller disclosed in my above-referenced patents, one of the angle mounts 136 is mounted in each one of the supports 134. As shown in FIG. 4, a bottom leg 160 of angle mount 136 is attached, as by rivets 162, to a forwardly projecting bottom portion 164 of support 134. String supporting and fixing means 44 is adjustably connected, by a bolt 166 (corresponding to above-described bolt 46) to an upstanding leg 168 of angle mount 136, the bolt extending through a slot 170 formed in such leg.

As above-described with respect to string supporting apparatus 40, one of strings 20 is received in V-notch 54 of saddle element 48 forming part of each string supporting and clamping means 44 and is clamped to such means by screw 76. Portions of strings 20 extending over bridge 18 beyond the clamping points pass over an arcuate upper surface 172 of tail piece member 106, ball ends 120 of the strings being inserted into, and held by, string end holders 114 (FIGS. 3 and 4).

By mounting string supporting and fixing means in support 130 in place of the rollers disclosed in my above-referenced patents, strings 20 are constrained (in notches 54) against any lateral movement at the bridge end support points as may occur with use of rollers which require side clearance for free pivoting. Since only a few thousandths of an inch of lateral string movement, enabled by roller clearance, is sufficient to cause clearly audible degredation of sound sustaining quality of instrument 10, sound of the instrument is greatly enhanced by use of the above-described, spring mounted string supporting and clamping means at bridge 18.

Fine pitch tuning of instrument 10, by turning of screws 122, is enabled without the unclamping of strings 20 at string supporting and fixing means 44 by the capability of angle mount upper legs 168 to flex (direction of arrows E-E', FIG. 4) a sufficient amount to enable such fine tuning.

It can be understood from the foregoing description that the nut-end string break points, defined by saddle element notches 54 at nut 32, and the bridge-end string break points, defined by saddle element notches 54 at bridge 18, do not remain fixed in position when tension in strings 20 is adjusted by operation of tuning pegs 24 associated with instrument head 14 or by fine tuning screws 122 associated with the bridge. Thus, for example, when tension in any of strings 20 is increased by taking up the string on the associated one of the machine heads 22, the corresponding one of the string supporting and fixing means 44 at nut 32 is pulled towards the machine head, the ear 92 to which such means 44 is attached being caused to flex accordingly. As a further example, when tension in any one of strings 20 is increased by the advancing of the corresponding fine tuning screw 122 in base 108, the associated one of the supporting and fixing means 44 at bridge is pulled towards the base, the associated mounting angle leg 168 flexing to permit such movement of means 44. Conversely, reducing tension in any one of the strings causes movement of the associated string supporting and fixing means 44 in the opposite direction.

It has been determined by the present inventor that the change in the vibrational or musical length, L, of strings 20 caused by movement of string supporting and fixing means 44 in response to retensioning of the strings is ordinarily only about 0.015 inches for a semitone of tuning. Such a change in string length, L, has been determined not to affect the sound produced by the string in a manner discernable to even a trained musician. In contrast, lateral movement of the bridge-end string support point by an amount of only about 0.001 or 0.002 inches during playing of instrument causes a reduction of sustaining sound which is readily discernable to even relatively non-musically trained persons.

Therefore, the advantages provided by the present invention, specifically the ability to retension strings 20 without unclamping or releasing the strings at means 44 and the elimination of lateral string movement at the bridge end string break point greatly outweigh any possible or potential disadvantages associated with movement of the string break points caused by retensioning of strings 20.

It is also to be appreciated that substantial advantages are provided by the described spring mounting of string supporting and fixing means 44 at either nut 32 or bridge 18. Although greater advantages may be achieved by spring mounting of means 44 at both nut 32 and bridge 18, such mounting at both ends of strings 20 is not essential to the invention.

Although there has been described above a specific arrangement of string supporting apparatus in accordance with the present invention for purposes of illustrating the manner in which the present invention may be used to advantage, it will be appreciated that the invention is not limited thereto. Accordingly, any and all modifications, variations or equivalent arrangements which may occur to those skilled in the art should be considered to be within the scope of the invention as defined in the appended claims.

What is claimed is:

1. Flexible string supporting apparatus for a musical instrument having a plurality of longitudinally extending strings stretched between a head and a body of the instrument, having head-end and body-end string break points which establish the vibrating length of the strings and having string tensioning means for adjusting the tensioning of said strings, said apparatus comprising:

(a) a plurality of string supporting means each having a laterally fixed, string supporting surface;

(b) means for resiliently mounting said string supporting means at at least one of said head-end and body-end string break points with each of said strings being supported by said string supporting surface of a corresponding one of the string supporting means;

said mounting means being configured for permitting the string supporting surface of each of said supporting means to move independently in the longitudinal string direction in response to adjusting tensioning of said strings by said tensioning means, the vibrating length of the strings being thereby caused to change; and (c) means for fixing the strings to the associated string supporting means adjacent said supporting surfaces.

2. The string supporting apparatus as claimed in claim 1 wherein each of said string supporting means comprise a string saddle member and a saddle mounting element, said mounting element including means defining a recess into which said saddle member is tightly received.

3. The string supporting means as claimed in claim 2 wherein said string fixing means include string clamping means connected to said saddle mounting element.

4. The string supporting apparatus as claimed in claim 2 wherein said string supporting surface comprises means defining a generally V-shaped notch in outer regions of said saddle member.

5. The string supporting apparatus as claimed in claim 1 wherein said resilient mounting means comprise a plurality of spring elements and means for attaching one of said string supporting means to a corresponding one of said spring elements.

6. The string supporting apparatus as claimed in claim 5 wherein said resilient mounting means comprise an elongate angle having a first leg and second leg and including means dividing said second leg into said plurality of spring elements.

7. The string supporting apparatus as claimed in claim 6 wherein the means dividing said second leg into the plurality of spring elements comprises means defining a slot between each one of said elements.

8. The string supporting and apparatus as claimed in claim 5 wherein the means for attaching one of the string supporting means to a corresponding one of the spring elements include means for enabling height adjustment of the supporting means relative to the resilient mounting means.

9. The string supporting apparatus as claimed in claim 1 wherein the resilient mounting means are configured for mounting the string supporting means at the head-end string break point at a nut position on the instrument.

10. The string supporting apparatus as claimed in claim 1 wherein the mounting means are configured for mounting the string supporting means to a bridge at the body-end string break point.

11. The string supporting apparatus as claimed in claim 1 including a tremulo bridge and the mounting means mounts the string supporting means to a fixed portion of said tremulo bridge and including means for mounting the tremulo bridge to the instrument body with the string supporting means positioned at the body-end string break point.

12. String supporting apparatus for a stringed instrument having a plurality of strings extending along an instrument neck between an instrument head and body, having a head-end string break point and a body-end string break point, said break points defining the vibrational length of the strings and having string take up means mounted to said head for causing the individual tensioning of said strings, said apparatus comprising:

(a) a plurality of string supporting means each having a laterally fixed string supporting surface, and each having means for fixing a string passing over the supporting surface relatively adjacent thereto; and (b) means for resiliently mounting said string supporting means to the instrument with said string supporting surfaces at the head-end break point with the strings supported by a corresponding one of the string supporting means, said resilient mounting means permitting the string supporting means to deflect individually a limited distance in the longitudinal string direction in response to the loosening or tightening of the strings by said string take up means, the location of the head-end string break point being thereby longitudinally shifted and the vibrational length of the strings being thereby changed according to the amount of deflection of the string supporting means.

13. The string supporting apparatus as claimed in claim 12 wherein the string supporting means comprise a detachable string support saddle, said string supporting surface comprising means defining a generally V-shaped notch in said saddle.

14. The string supporting apparatus as claimed in claim 12 wherein said resilient mounting means comprise an angle member having a first leg and a second leg formed at about right angles thereto, and including means for separating said second leg into a plurality of side by side ears.

15. The string supporting apparatus as claimed in claim 14 including means for mounting said first leg to said instrument and means for attaching said string supporting means to corresponding ones of said second leg ears.

16. The string supporting apparatus as claimed in claim 15 wherein the means for attaching the string supporting means to the second leg ears are configured for permitting limited height adjustment of the supporting means relative to said ears.

17. The string supporting apparatus as claimed in claim 12 wherein the fixing means clamp the string intermediate the string supporting surfaces and the string take up means.

18. String supporting apparatus for a stringed instrument having a plurality of strings extending along an instrument neck between an instrument head and body, having a head-end string break point and a body-end string point, said break points defining the vibrational length of the strings, said apparatus comprising:

(a) a plurality of string supporting means each having a laterally fixed string supporting surface and each having means for fixing a string passing over the supporting surface relatively adjacent thereto;

(b) a bridge having pitch tuning means for causing the individual pitch tuning of the strings and means for mounting said bridge to the body of the instrument; and (c) means for resiliently mounting each of the string supporting means to the bridge so that the string supporting surfaces comprise the body-end string break point, and with the strings supported by corresponding ones of the string supporting means, said resilient mounting means permitting the string supporting means to deflect individually in the longitudinal string direction in response to loosening or tightening of the strings by the pitch tuning means, the location of the body-end string break point being thereby longitudinally shifted and the vibrational length of the strings being thereby changed according to the amount of deflection of the string supporting means.

19. The string supporting apparatus as claimed in claim 18 wherein the string supporting means comprise a detachable string support saddle, said string supporting surface comprising means defining a generally V-shaped notch in said saddle.

20. The string supporting apparatus as claimed in claim 18 wherein said resilient mounting means comprise a plurality of angle members each having a first leg and a second leg formed at about right angles thereto, and including means for mounting said first legs to said bridge and means for attaching individual ones of the string supporting means to corresponding ones of said second legs.

21. The string supporting apparatus as claimed in claim 20 wherein the means for attaching the string supporting means to the second legs are configured for permitting limited height adjusting of the supporting means relative to said second legs.

22. The string supporting apparatus as claimed in claim 18 wherein the fixing means clamp the strings between the string supported surfaces and the pitch tuning means.

* * * * *